United States Patent [19]

Mixon et al.

[11] Patent Number: 5,003,883

[45] Date of Patent: Apr. 2, 1991

[54] LIGHTWEIGHT BLAST SHIELD

[75] Inventors: Larry C. Mixon, Madison; George W. Snyder, Huntsville; Scott D. Hill, Toney; Gregory L. Johnson, Decatur; J. Frank Wlodarski; Alexis P. von Spakovsky, both of Huntsville; John D. Emerson, Arab; James M. Cole; John P. Tipton, both of Huntsville, all of Ala.

[73] Assignee: The United States of America as represented by the Secretary of the Army, Washington, D.C.

[21] Appl. No.: 555,951

[22] Filed: Jul. 23, 1990

[51] Int. Cl.[5] ..... F42B 12/10

[52] U.S. Cl. ..... 102/476; 102/308; 102/478

[58] Field of Search ..... 102/308, 476, 478

[56] References Cited

U.S. PATENT DOCUMENTS

| | | | |
|---|---|---|---|
| 2,804,823 | 9/1957 | Jablansky | 102/476 |
| 4,781,117 | 11/1988 | Garnett et al. | 102/493 |
| 4,874,219 | 10/1989 | Arroyo et al. | 350/96.23 |

FOREIGN PATENT DOCUMENTS

| | | | |
|---|---|---|---|
| 176885 | 4/1986 | European Pat. Off. | 102/476 |
| 2488390 | 2/1982 | France | 102/476 |
| 2552869 | 4/1985 | France | 102/476 |

OTHER PUBLICATIONS

"A Blast Shield Model for Tandem Warheads", by Glenn W. Weaver & William P. Walters, Jun. 1987, pp. 1–19.

*Primary Examiner*—Harold J. Tudor

*Attorney, Agent, or Firm*—Freddie M. Bush; James T. Deaton

[57] ABSTRACT

A tandem warhead missile arrangement that has a composite material housing structure with a first warhead mounted at one end and a second warhead mounted near another end of the composite structure with a dome shaped composite material blast shield mounted between the warheads to protect the second warhead from the blast of the first warhead.

10 Claims, 1 Drawing Sheet

LIGHTWEIGHT BLAST SHIELD

DEDICATORY CLAUSE

The invention described herein may be manufactured, used, and licensed by or for the Government for governmental purposes without the payment to us of any royalties thereon.

BACKGROUND OF THE INVENTION

Due to the advancement in armor technology, current anti-tank missile systems require more sophisticated warhead technology to provide the necessary lethality. One technology used to combat the armor threat is tandem explosive warheads such as shaped charges or explosively formed penetrators, which use two or more warheads in series to attack the armor. The precursor warhead(s) removes part of the armor, allowing the following warhead(s), main charge, to attack a more vulnerable portion of the target. These tandem warhead systems insert a time delay between the warhead initiations to allow each warhead to react with the armor. The delay time is required to allow the precursor warhead(s) to initiate any reactive armor elements and expend its energy before the main charge warhead is initiated or its performance capabilities are deteriorated by the front charge initiation. The main charge warhead(s) must be protected from the blast from the preceding warhead so optimum performance of the main charge may be achieved against the most vulnerable portions of the armor. The protection/separation structure is referred to as the blast shield.

Traditionally, there are three different methods of protecting the main charge warhead(s). One of these methods is to use metal bulkheads which rely on mass alone to separate the blast effects of the precursor warhead(s) from the main charge. The large mass simply provides high resistance to movement (inertial forces), which prevents the blast shield from being accelerated into the rear main charge warhead(s). However, the large mass of the metal blast shield can often reduce the penetration performance of the main warhead by as much as 20 percent. This type of shield approach is documented in BRL Technical Report BRL-TR-2814 by Weaver and Walters, June 1987. The metal blast approach to protect the main warhead is effective but adds mass to the missile, which reduces missile range and maneuverability. Additionally, adding mass to the blast shield is inefficient and less desirable than adding mass to the warhead.

A second approach sometimes used to protect the main or secondary warhead(s) is to use components already in the missile as the blast shield. The component blast shield approach depends on the missile having components that can be repackaged to withstand the pressure induced by the precursor warhead(s) and can be relocated between the warheads. The relocation approach often times cannot be used in some missile systems due to system integration requirements/restraints as well as being very cost inefficient.

The third approach to shielding between multiple warheads concepts is to provide sufficient space between the warheads so the pressure will dissipate before degrading the performance of the main charge. This approach is very difficult to integrate into an existing system, and usually requires an extendable missile section to gain the extra spacing The extendable probe concept is not very space efficient since the collapsed mode extension sections require free space in the missile body.

Therefore, it can be appreciated that there is a great need for a tandem warhead in which a good shield can be positioned between the tandem warheads to protect the second warhead and at the same time provide of light weight construction.

Accordingly, it is an object of this invention to provide a light weight fiber/epoxy composite material blast shield for tandem warheads that is effective and relatively inexpensive.

Another object of this invention is to provide a blast shield which utilizes the high strength-to-density ratio of composite material to reduce the total mass needed for the shield.

Still another object of this invention is to provide a combination of the optimized geometry and composite materials in making a shield for tandem warheads to provide the capability of reducing the overall weight by as much as seventy percent compared to the use of metal blast shields.

Other objects and advantages of this invention will be obvious to those skilled in this art.

SUMMARY OF THE INVENTION

In accordance with this invention, a missile structure is provided that has tandem warheads with a light weight fiber/epoxy composite material blast shield between the tandem warheads with the blast shield being utilized of high strength-to-density ratio of composite materials to reduce total weight needed for the shield and the combination of optimized geometry and composite materials providing a missile structure that is considerably reduced in weight.

DESCRIPTION OF THE PREFERRED EMBODIMENT

Figure 1:
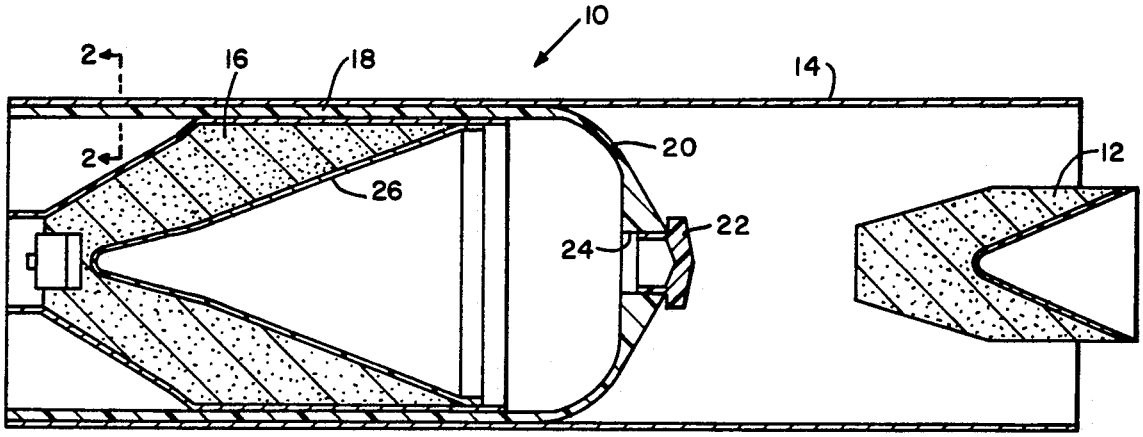
FIG. 1 illustrates tandem warheads mounted relative to composite materials with a composite material blast shield mounted between the warheads.
Figure 2:
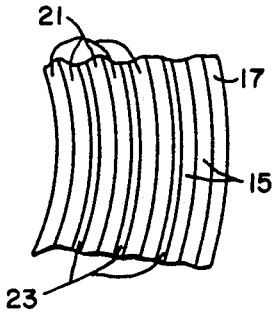
FIG. 2 is a sectional view along line 2—2 of FIG. 1 as an enlarged fragmentary view illustrating layers of the housing structure.

Referring now to the drawing, a tandem warhead arrangement 10 includes first warhead 12 mounted at one end of elongated cylindrical housing 14 in a conventional manner and second warhead 16 mounted in housing section 18 in a conventional manner. Housing section 18 has a dome shaped portion 20 at one end with a central opening 24, and an aluminum plug 22 closes opening 24 through dome 20. Dome 20 and plug 22 act as a light weight blast shield for protecting second warhead 16 from the blast of warhead 12 when warhead 12 is set off. Housing portion 18 and dome section 20 are made of epoxy coated composite material such as S-Glass that has a high toughness characteristic. The cylinder portion 18 and dome portion 20 have been successfully constructed (see FIG. 2) of 6 helical layers 21 and three half hoop layers 23 of S-glass fiber wound around a mandrel, with S-glass cloth interspersed between the helical layers. Housing cylindrical portion 14 is made of epoxy coated graphite fiber and has been constructed of two helical layers 15 and one hoop layer 17 of t-40 Graphite. Aluminum plug 22 that is located in the center of dome 20 is used to plug opening 24 that is left when the winding mandrel is removed from housing portion 18 and dome portion 20. Opening 24 also provides a passage through which the penetrator of warhead 16 and the jet formed by warhead 16 can pass when set off so that these can pass through opening 24 on their way to the target that is to be damaged or destroyed.

In operation, when the tandem warhead assembly has been delivered by a missile to its target, front warhead 12 is set off in a conventional manner to destroy any armor around the target proper and when warhead 12 is set off, the blast from warhead 12 quickly blows out the section of housing 14 around warhead 12 and onto dome section 20 to relieve the pressure from front warhead 12 that is directed toward warhead 16. The portion directed on the blast shield is directed radially outwardly by the shape of dome section 20 of the blast shield. The walls of cylindrical housing portion 14 are especially thin and designed with specific material to fail quickly to thus allow pressure from warhead 12 to be vented outward and cause the dome shape of dome section 20 to radially direct the blast pressure from front warhead 12 outward. This quick venting of the pressure from the blast of the front warhead 12 is important to the decreased total impulse imparted to blast shield 20, 22 and allows it to remain in tact and protect rear warhead 16 for the required delay time. This specific construction of housing 14 and dome 20 allows for a much lighter blast shield and a shield that still protects rear warhead 16. At the appropriate time, rear warhead 16 is set off in a conventional manner and the setting off of rear warhead 16 produces a penetrator from metal liner 26 that is caused to pass through opening 24 and a jet which also passes through passage 24 after plug 22 has been blown out by the forces produced by the rear warhead. Finally, forces from rear warhead 16 are applied to a target to kill the target.

Blast shield weight is considered parasitic weight in a missile system, since it is 'dead weight', in the missile. Applicants, lightweight composite material blast shield offers a reduction in this parasitic weight, without sacrificing warhead section performance. Other anti-armor explosive warhead missile systems currently use blast shields on the order of 2 of 6 lbs. This weight is located in the front of the missile, causing maneuverability problems and reducing missile range due to the increased missile mass. Additionally, the metal blast shield mass is in the main shaped charge jet path and degrades the penetration performance. Applicants' composite blast shield technology can be incorporated into specific system's needs with a much lower weight penalty, as well as providing less material in the path of the main charges jet. Therefore, this technology reduces the parasitic weight imparted on a tandem explosive warhead missile system from 2 to 6 lbs to something less than 1.5 lbs. The blast shields currently in use in missile systems are generally conical in shape, with the cone extending forward from the base of the shield. These metal blast shields are usually located some distance in front of the rear warhead to allow the shield to translate rearward when the blast pressure acts on it. Therefore these shields require 4 inches or more of missile length, including the free space behind the shield and the length taken up by the conical section protruding from the front of the shield. Applicants' composite missile structure blast shield offers the potential to reduce the overall missile length required for the blast shield. This shield requires no space behind it for movement and no more than 3 inches of missile length in front for installation. Therefore, applicants' shield technology reduces the empty missile length required to house the blast shield, allowing more space for other components or the possibility of shortening the overall missile length.

We claim:

1. A tandem warhead missile assembly comprising, and elongated composite material housing of wound fiber and epoxy, first and second warheads mounted in said housing in spaced relationship, and a dome shaped composite material blast shield of wound fiber and epoxy, made integral with said housing, separating said first and second warheads and for protecting said second warhead from explosive blast of said first warhead.

2. A tandem warhead missile assembly as set forth in claim 1, wherein said housing has two sections with a first section of said housing mounting said first warhead and a second section of said housing mounting said second warhead with said blast shield being made of the same material as said second housing section and as an integral part of said second housing section.

3. A tandem warhead missile assembly as set forth in claim 2, wherein said dome shaped blast shield has an opening there through with a plug plugging said opening of said blast shield.

4. A tandem warhead missile assembly as set forth in claim 3, wherein said dome shape of said blast shield is oriented relative to said first warhead such that a blast from said first warhead will be directed radially outward by said blast shield and said first housing section being made of such composite material that a portion of said first housing section will quickly fail to allow blast pressure from the first warhead to be vented outward.

5. A tandem warhead missile assembly as set forth in claim 4, wherein said first housing section is made of two helical layers and one hoop layer of graphite material.

6. A tandem warhead missile assembly as set forth in claim 5, wherein said second housing section and said dome shaped blast shield are made of a plurality of layers of glass material.

7. A tandem warhead missile assembly comprising, an elongated and cylindrical housing section that has a rear housing section that terminates at one end in a dome section, said rear housing section and said dome section being made of a plurality of layers of wound fiber composite material that is bonded together with an epoxy, said housing section further having an outer layer that extends the entire length of said housing section and being an outer structure that is made of wound fiber composite material that readily fails quickly due to pressure blast, said outer layer of composite material being bonded together and made integral with said rear housing section and with said dome being intermediate said rear housing section and a front portion of said outer housing layer, a first warhead mounted in a front portion of said outer housing layer and a second warhead mounted in a rear portion of said rear housing section, and said dome section having an opening through the center thereof.

8. A tandem warhead missile assembly as set forth in claim 7, wherein said outer housing layer is made of graphite material and includes two helical layers and one hoop layer of said graphite material.

9. A tandem warhead missile assembly as set forth in claim 8, wherein said rear housing section and said dome are made of glass material and include at least six helical and three half hoop layers of said glass material.

10. A tandem warhead missile assembly as set forth in claim 9, wherein said dome section has a plug that plugs said opening.

* * * * *